US010875700B2

(12) United States Patent
Moore

(10) Patent No.: US 10,875,700 B2
(45) Date of Patent: Dec. 29, 2020

(54) REDUCER INSERT FOR DISPENSING LIQUIDS

(71) Applicant: Modaliti, L.L.C., Salt Lake City, UT (US)

(72) Inventor: Gary C. Moore, Salt Lake City, UT (US)

( * ) Notice: Subject to any disclaimer, the term of this patent is extended or adjusted under 35 U.S.C. 154(b) by 260 days.

(21) Appl. No.: 15/952,673

(22) Filed: Apr. 13, 2018

(65) Prior Publication Data

US 2019/0112121 A1 Apr. 18, 2019

Related U.S. Application Data

(60) Provisional application No. 62/485,152, filed on Apr. 13, 2017.

(51) Int. Cl.

| | |
|---|---|
| ***B65D 83/00*** | (2006.01) |
| ***B65B 3/04*** | (2006.01) |
| ***B65B 39/12*** | (2006.01) |
| ***B67D 3/00*** | (2006.01) |
| ***B65B 39/02*** | (2006.01) |

(52) U.S. Cl.

CPC ..... *B65D 83/0055* (2013.01); *B65B 3/04* (2013.01); *B65B 39/02* (2013.01); *B65B 39/12* (2013.01); *B67D 3/00* (2013.01)

(58) Field of Classification Search

CPC ..... B65D 83/0055; B65B 3/04; B65B 39/02; B65B 39/12; B67D 3/02

USPC .... 141/311 A, 319, 331–345, 351, 363–366, 141/369, 388, 389; 222/213, 225, 494, 222/546, 567, 571

See application file for complete search history.

(56) References Cited

U.S. PATENT DOCUMENTS 2,207,176 A * 7/1940 Phillips ..... B65D 47/18 222/215
2,500,404 A * 3/1950 Donnelly ..... E03C 1/306 4/255.06
2,554,570 A * 5/1951 Harvey ..... G01F 11/08 222/207
2,628,759 A * 2/1953 Bodendoerfer ..... B67C 3/2637 141/293
2,696,337 A * 12/1954 Dinhofer ..... A45D 33/006 141/349
2,732,108 A * 1/1956 Haddad ..... B65D 47/06 222/564
2,808,183 A * 10/1957 Olson ..... B65D 47/2062 222/498
3,165,243 A * 1/1965 Haynes ..... B65D 47/20 222/498
3,638,690 A * 2/1972 Bjerregaard ..... F23Q 2/52 141/354

(Continued)

*Primary Examiner* — Timothy L Maust
(74) *Attorney, Agent, or Firm* — Intellectual Strategies

(57) ABSTRACT

An apparatus includes a pliable material to form a dispenser insert. The dispenser insert includes a lower section and an upper section. The lower section is configured for insertion into and stable engagement with the mouth and interior of a dispensing container. The upper section is configured to extend outward and away from the mouth of the dispensing container. The upper section defines an orifice at a distal end of the upper section. The orifice maintains a closed configuration in an undeformed state and an open configuration for passage of a liquid in a deformed state subject to application of an external force on the upper section of the dispenser insert.

9 Claims, 7 Drawing Sheets

(56) References Cited

U.S. PATENT DOCUMENTS

| | | | | | |
|---|---|---|---|---|---|
| 3,799,222 | A * | 3/1974 | Franz | B67C 3/16 | 141/291 |
| 3,871,425 | A * | 3/1975 | Fee | B67C 3/26 | 141/5 |
| 4,705,195 | A * | 11/1987 | Heck | A47K 11/10 | 222/207 |
| 5,277,234 | A * | 1/1994 | Warstler | B67C 11/04 | 141/297 |
| 5,632,315 | A * | 5/1997 | Rose | A61J 1/2089 | 141/329 |
| 7,213,727 | B2 * | 5/2007 | Kokubo | B65D 47/0838 | 215/320 |
| 8,220,666 | B2 * | 7/2012 | Abe | A47K 5/1204 | 222/181.2 |
| 8,393,361 | B2 * | 3/2013 | Luchinger | G01G 13/02 | 141/332 |
| 8,596,501 | B2 * | 12/2013 | Hagleitner | A47K 5/1208 | 222/207 |

* cited by examiner

REDUCER INSERT FOR DISPENSING LIQUIDS

CROSS-REFERENCE TO RELATED APPLICATIONS

This application is claims the benefit of priority of U.S. Provisional Patent Application No. 62/485,152 entitled "Essential Oil Sampling and Dispensing Orifice Reducer Insert" filed on Apr. 13, 2017. The subject matter of that application is incorporated herein in its entirety.

BACKGROUND

This present disclosure relates to a design of a protruding plastic tip with a rubber O-ring near the top, or for a complete rubber insert, used for dispensing essential oil from glass bottles in an efficient and convenient way that eliminates waste.

There is a need for an improved design of a dispensing unit for essential oil bottles. The purpose of the orifice reducers currently on the market is to insert into the top of an essential oil bottle, dispense the oil precisely through a hole surrounded by an oil spill compartment that has openings to dispense the oil back into the bottle. When using a plastic orifice reducer/oil dispenser which is currently on the market, one can tell that it does not dispense the oil in a precise, efficient way and promotes waste of the oil product. When tipped to dispense oil, the plastic oil dispenser allows oil to flow down the side of the bottle as well as across the top of the dispenser. There is also not a way to successfully seal the openings of the orifice reducer by putting the cap on. This can lead to essential oil spilling into the closed cap creating waste of the oil. Essential oil sample bottles are widely used for sampling and distributing purposes. There is a need to effectively transfer the essential oil from the main bottle into a sample bottle which the orifice reducers currently on the market do not accomplish in an efficient manner. There is a need for a new design of an essential oil orifice reducer that efficiently lets the user drip the oil in a way that eliminates waste and effectively seals the opening when the cap is in place. There is also a need for an effective way to transfer oil into sample bottles.

SUMMARY OF THE DESCRIPTION

An apparatus includes a pliable material to form a dispenser insert. The dispenser insert includes a lower section and an upper section. The lower section is configured for insertion into and stable engagement with the mouth and interior of a dispensing container. The upper section is configured to extend outward and away from the mouth of the dispensing container. The upper section defines an orifice at a distal end of the upper section. The orifice maintains a closed configuration in an undeformed state and an open configuration for passage of a liquid in a deformed state subject to application of an external force on the upper section of the dispenser insert. Other embodiments are also described.

BRIEF DESCRIPTION OF THE DRAWINGS

In order that features and advantages of embodiments referenced herein will be readily understood, a more particular description of various embodiments will be rendered by reference to specific components, features, and functions thereof, which are illustrated in the appended drawings. The drawings depict various embodiments and are not, therefore, to be considered as limiting the scope of the claimed invention. The embodiments are described and explained with additional specificity and detail through the use of the accompanying drawings in which:

DETAILED DESCRIPTION

Figure 4:
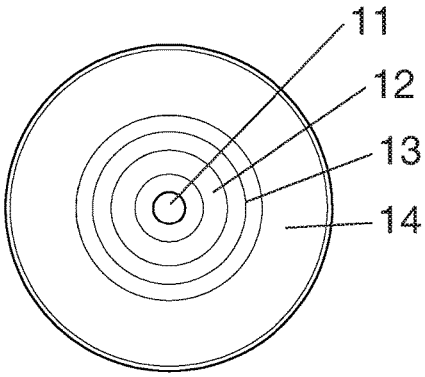
FIG. 4 illustrates a top view of the essential oil sampling and dispensing tip insert of FIG. 1.
Figure 5:
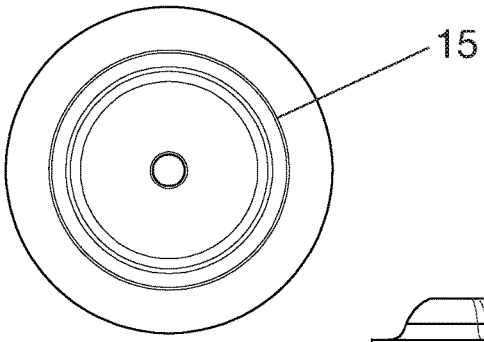
FIG. 5 illustrates a bottom view of the essential oil sampling and dispensing tip insert of FIG. 1.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of embodiments may be combined in any suitable manner in other embodiments. One skilled in the relevant art will recognize, however, that embodiments may be practiced without one or more of the specific details, or with other methods, components, materials, and so forth. In other instances, well-known structures, materials, or operations are not shown or described in detail to avoid obscuring aspects of certain embodiments.

The schematic flow chart diagrams included herein, if any, are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

This present disclosure relates to a design of a plastic sampling and dispensing tip with a rubber O-ring near the top, or a completely rubber sampling and dispensing tip insert used for dispensing essential oil from glass bottles in an efficient and convenient way that eliminates waste. This product is intended to fit with the existing design and shape of standard essential oil bottles and caps. It is an orifice reducer, referred to as a sampling and dispensing tip insert or simply a dispensing tip insert. The dispensing tip insert fits into the neck of the bottle and on top of the rim with the purpose of dispensing essential oils. It is designed to be inserted and held securely into the bottle opening, creating a seal that blocks oil from coming out the sides of the bottle opening.

This sampling and dispensing tip insert is made from a corrosive-resistant plastic, such as HDPE or PP, with an O-ring placed near the top which is made of a flexible, oil-resistant rubber, such as Viton. In another embodiment, the dispensing tip is made completely of a flexible, oil-resistant rubber, such as Viton. The flexible rubber creates more options of functionality. The neck of the dispensing tip insert is protruding out beyond the top of the insert, which more efficiently dispenses the oil in a precise manner. The oil can drip from the protruding neck in a way that avoids contact with the rest of the dispensing tip insert, thus preventing the oil from running down the neck, top of the dispensing tip insert, and bottle. The neck is designed to reduce waste when dispensing the essential oil.

This essential oil sampling and dispensing tip insert is also designed for dispensing essential oils from standard oil bottles into sample bottles. The flexible rubber creates a process in which, when inserted into the neck of the sample bottle, the O-ring, or flexible part top area of the all rubber version, will compress to tightly fit within the neck of the sample bottle. The rubber section will insert past the neck internally in a vertical configuration, with the sample bottle right-side up and the oil bottle upside-down. When it is pulled back out, a vacuum effect occurs, leaving the bottle cavity under a negative pressure. As the bottle pulls out, the oil is forced out of the dispensing tip into the sample bottle in a relatively consistent amount. The user can transfer a certain amount of oil from the bottle to the sample bottle. Several insertions and extractions will fill a desired amount of the sample bottle for convenient measurement. This method of connecting the sample bottles to the rubber essential oil sampling and dispensing tip insert is designed to be easier, faster, cleaner and more efficient eliminating waste.

Figure 1:
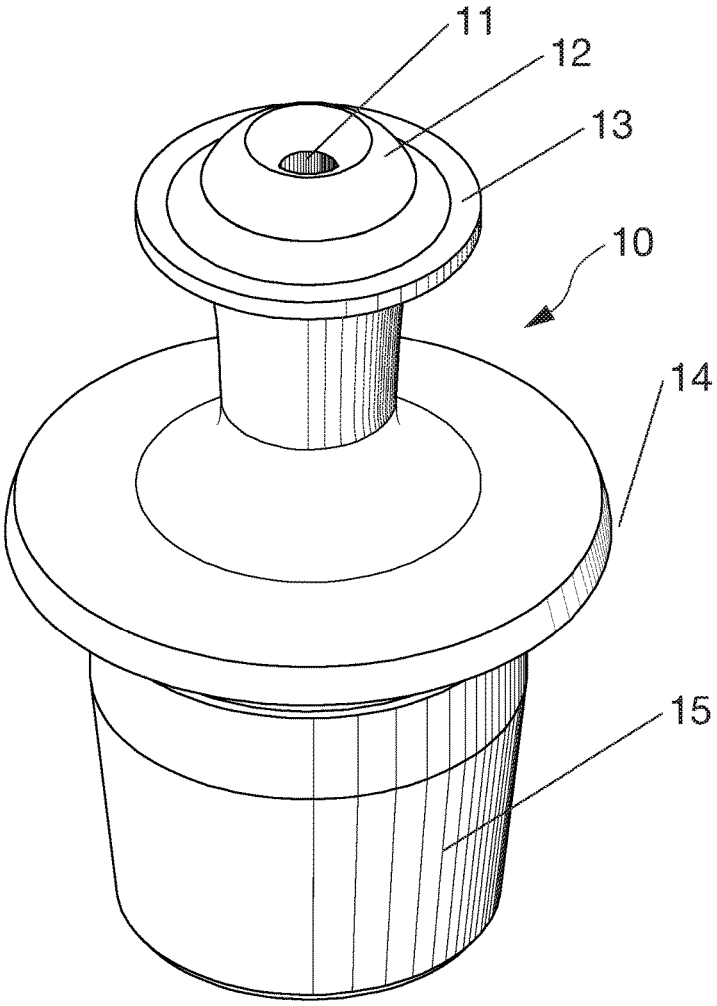
FIG. 1 illustrates one embodiment of an essential oil sampling and dispensing tip insert made from plastic with a rubber ring.

FIG. 1 shows the essential oil sampling and dispensing tip insert according to at least one embodiment. The cylindrical base 15 of the essential oil sampling and dispensing tip insert 10 is what is inserted into the essential oil bottle, creating a seal for the bottle. In some embodiments the cylindrical base 15 connects into the existing design and shape of standard essential oil bottles. In some embodiments the circular rim of the dispensing tip insert 14 rests on the top of the bottle and projects a small amount upward becoming a further seal to the bottle. In some embodiments the design is for the oil to flow through from the opening in the bottom of the dispensing tip insert 18 through the base of the neck to the protruding neck of the neck 19 and through a hole 11 with a rounded or flat head of the neck 12 to guide oil out of the bottle in a precise way, eliminating waste.

Figure 2:
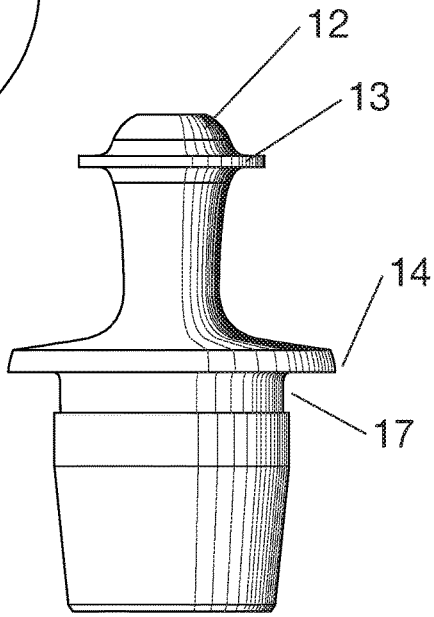
FIG. 2 shows a side view of the essential oil sampling and dispensing tip insert of FIG. 1.

FIG. 2 shows a side view of the essential oil sampling and dispensing tip insert with the elements of the previously discussed FIG. 1. There is an indented ring 17 around the top of the base 15 to hold the insert securely into the essential oil bottle.

Figure 3:
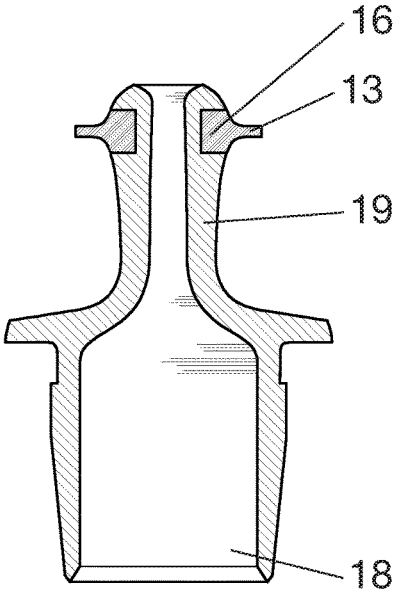
FIG. 3 shows a side cut-away view of the essential oil sampling and dispensing tip insert of FIG. 1.
Figure 9:
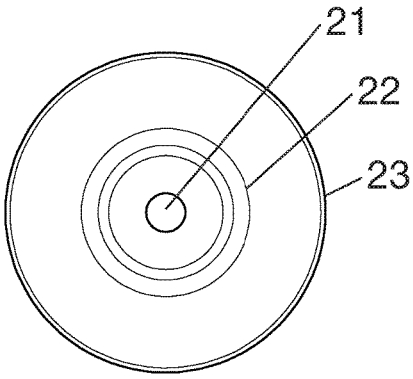
FIG. 9 illustrates a top view of the essential oil sampling and dispensing tip insert of FIG. 6.
Figure 10:
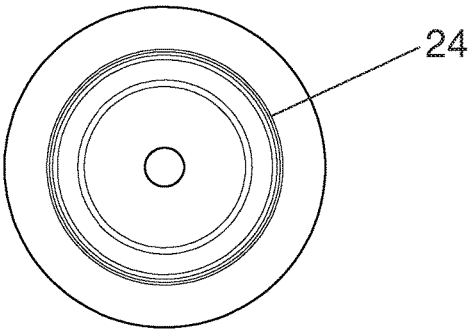
FIG. 10 illustrates a bottom view of the essential oil sampling and dispensing tip insert of FIG. 6.

FIG. 3 shows a cut-away side view of the essential oil sampling and dispensing tip insert. The body of the insert 10 is made from a non-corrosive plastic for use with oil, such as HDPE or PP. A flexible O-ring 16 is assembled onto the top of the neck to create a tight suction seal with a sample bottle neck. The flexible O-ring 16 will have an extended area 13 that will deform to create a tight fit inside the sample bottle neck.

Figure 6:
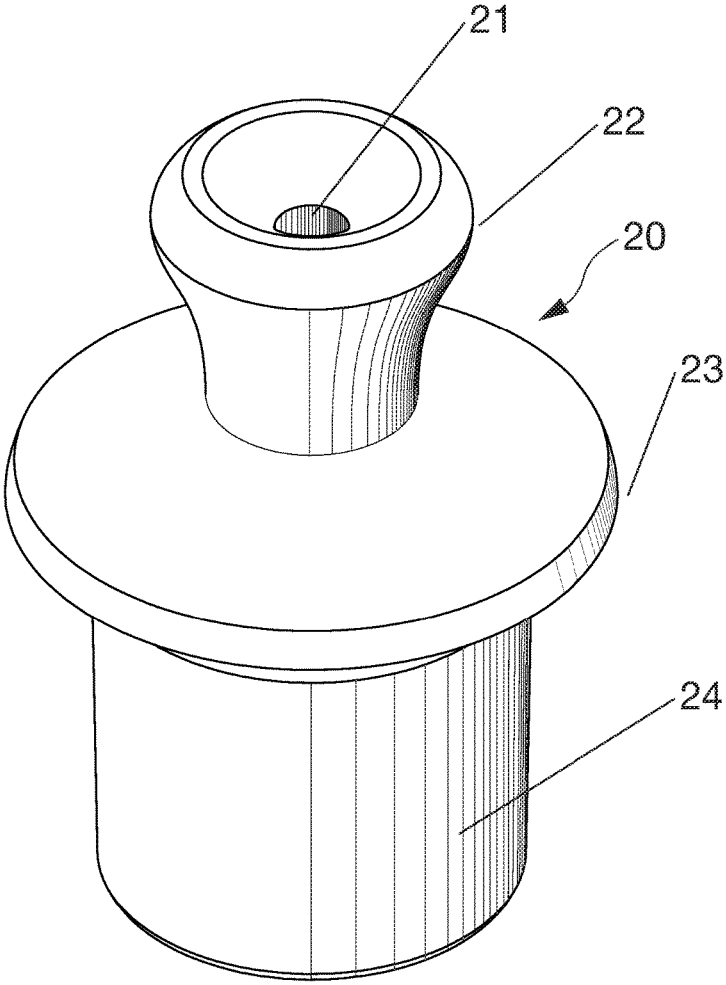
FIG. 6 illustrates another embodiment of an essential oil sampling and dispensing tip insert made from rubber.

FIG. 6 shows the essential oil sampling and dispensing tip insert according to at least one embodiment. The cylindrical base 24 of the essential oil sampling and dispensing tip insert 20 is what is inserted into the essential oil bottle, creating a seal for the bottle. In some embodiments the cylindrical base 24 connects into the existing design and shape of standard essential oil bottles. In some embodiments the circular rim of the dispensing tip insert 23 rests on the top of the bottle and projects a small amount upward becoming a further seal to the bottle. In some embodiments the design is for the oil to flow through from the opening in the bottom of the dispensing tip insert 26 through the base of the neck to the protruding neck of the neck 27 and through a hole 21 with a rounded or flat head of the neck 22 to guide oil out of the bottle in a precise way, eliminating waste.

Figure 7:
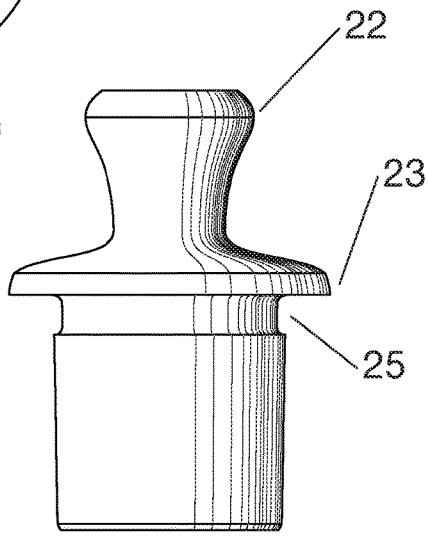
FIG. 7 shows a side view of the essential oil sampling and dispensing tip insert of FIG. 6.

FIG. 7 shows a side view of the essential oil sampling and dispensing tip insert with the elements of the previously discussed FIG. 6. There is an indented ring 25 around the top of the base 24 to hold the insert securely into the essential oil bottle.

Figure 8:
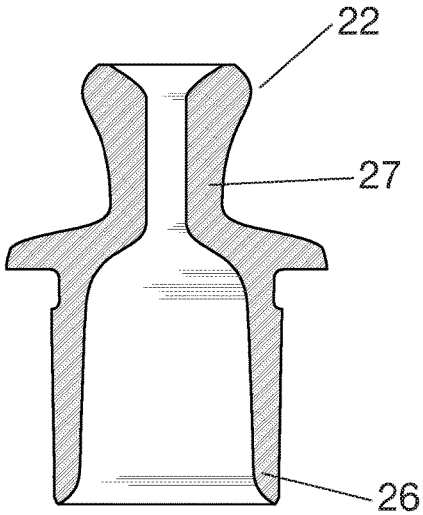
FIG. 8 shows a side cut-away view of the essential oil sampling and dispensing tip insert of FIG. 6.

FIG. 8 shows a cut-away side view of the essential oil sampling and dispensing tip insert. The body of the insert 20 is made from a non-corrosive flexible rubber for use with oil, such as Viton.

Figure 11A:
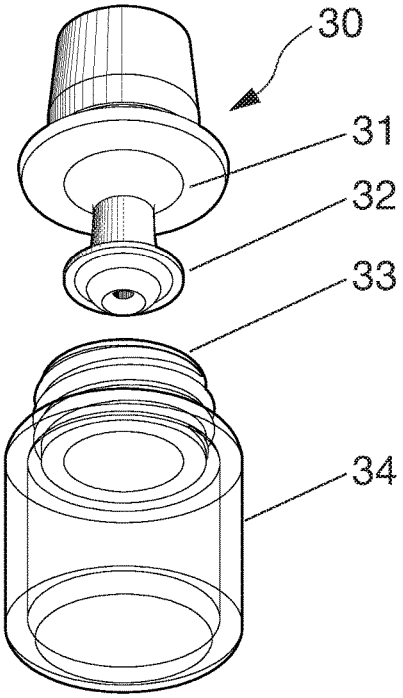
FIG. 11A-11B illustrates an embodiment of an essential oil sampling and dispensing tip insert being inserted into a sample bottle.

FIG. 11A shows a perspective view of the essential oil sampling and dispensing tip insert 30 and a sample oil bottle 34. The rubber O-ring at the end of the neck 32 is slightly wider in diameter than the inner diameter of the neck of the sample bottle 33.

Figure 11B:
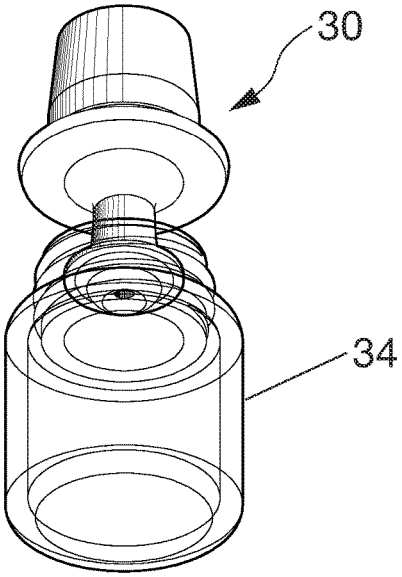

FIG. 11B shows a perspective view of the essential oil sampling and dispensing tip insert 30 as it is inserted into a sample oil bottle 34.

Figure 12A:
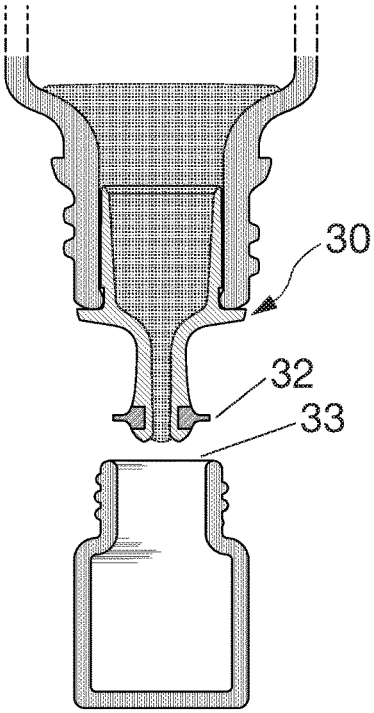
FIG. 12A-12C illustrates a cut-away view of an embodiment of a plastic essential oil sampling and dispensing tip insert being inserted into a sample bottle.
Figure 12B:
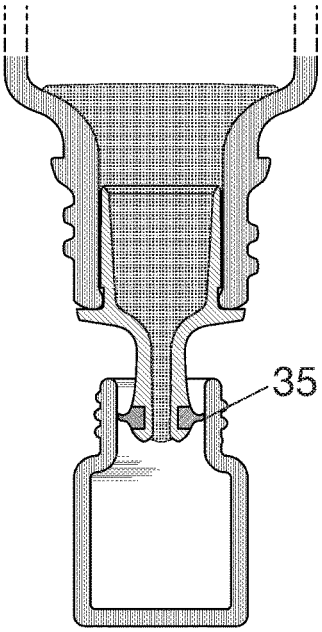
Figure 12C:
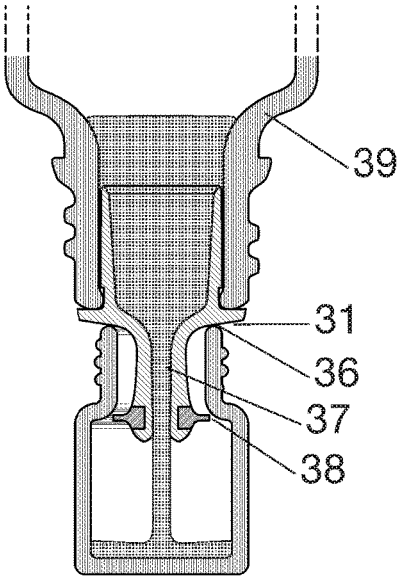

FIGS. 12A-12C illustrate a cut-away side view of the essential oil sampling and dispensing tip insert 30 on an oil bottle 39 as it inserts into a sample bottle 34. In this embodiment, the tip of the insert is forced into the neck of the sample bottle 33. Because the diameter of the rubber O-ring 32 is slightly larger than the inner diameter of the sample bottle 33, it collapses slightly 35 to form a tight seal inside the sample bottle (FIG. 12B). The length of the neck of the insert 37 is determined so when it is fully inserted into the sample bottle 34, the rubber O-ring 32 goes past the neck portion of the sample bottle 33 and maxes out where the top area of the insert 31 contacts the outer ring of the sample bottle 36, allowing air to enter back into the sample bottle 38, releasing the pressure condition. When the insert 30 is pulled back out of the sample bottle 34, the O-ring 32 again creates a seal in the neck of the sample bottle 33 and creates a vacuum within the sample bottle 34. This vacuum condition draws oil out of the oil bottle 39 through the essential oil sampling and dispensing tip insert 30 into the sample bottle 34.

Figure 13:
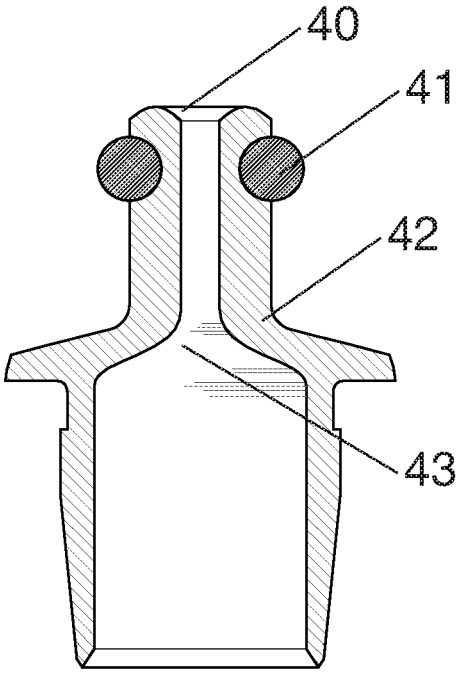
FIG. 13 illustrates an embodiment of an essential oil sampling and dispensing tip insert with a round profile O-ring.
Figure 14:
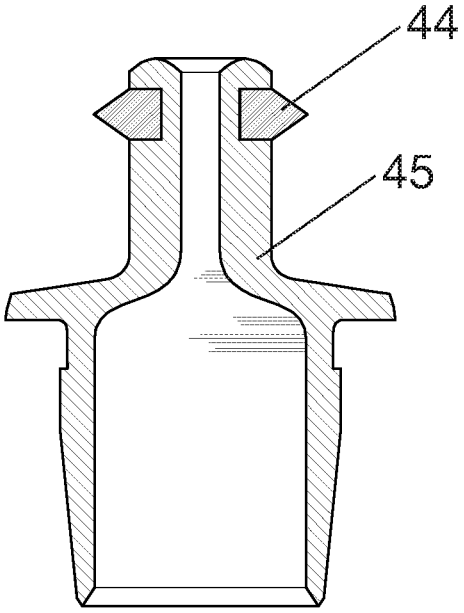
FIG. 14 illustrates an embodiment of an essential oil sampling and dispensing tip insert with an angled sharp profile O-ring.
Figure 15:
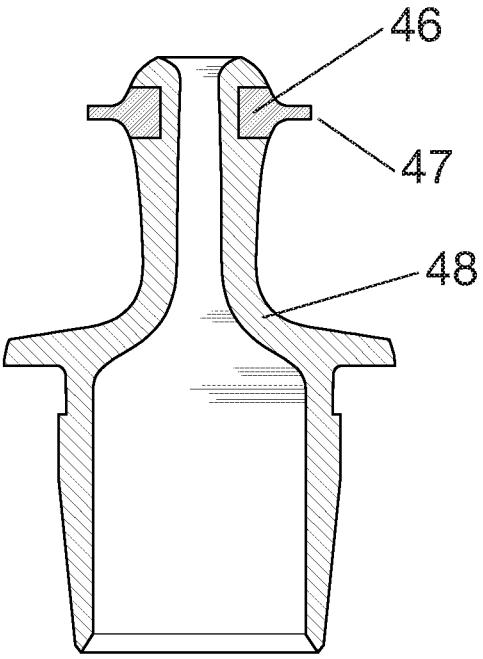
FIG. 15 illustrates an embodiment of an essential oil sampling and dispensing tip insert with a thin flap profile O-ring.
Figure 16:
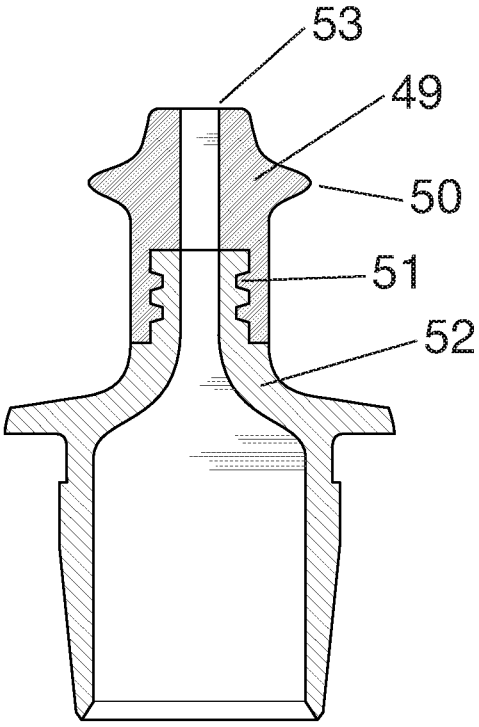
FIG. 16 illustrates an embodiment of an essential oil sampling and dispensing tip insert with the entire upper section being rubber and connected with a toothed or threaded interface.

FIGS. 13, 14, 15 and 16 show cut-aways of additional iterations of the essential oil sampling and dispensing tip insert in the plastic+rubber configuration. FIG. 13 shows a plastic body 42 with rubber O-ring in a circular cut-away configuration 41. The top of the hole could be a rounded configuration (40) or a squared-off top of the hole 53 as shown in FIG. 16. The inside is shaped in a smooth, curvy funnel-like shape 43 to allow ease of the oil flowing out. FIG. 14 depicts the same plastic body 45 as FIG. 13, but with a different cut-away profile of the O-ring, one shaped in a sharper, more chisel-form 44. FIG. 15 depicts the same plastic body 48 as FIG. 13, but with a different cut-away profile of the O-ring 46, one shaped with a smooth disc-form 47 for maximum distortion and sealing ability. FIG. 16 depicts a similar design as FIG. 13, having a plastic body 52, but with the upper neck 49 made from a flexible rubber such as Viton. The widest section of the upper neck 50 is molded slightly wider than the inner diameter of a sample bottle. The upper neck portion 49 is connected to the plastic body 52 by a tooth-fit or threaded 51, held in place with friction, or adhesive, or co-molded.

Figure 17:
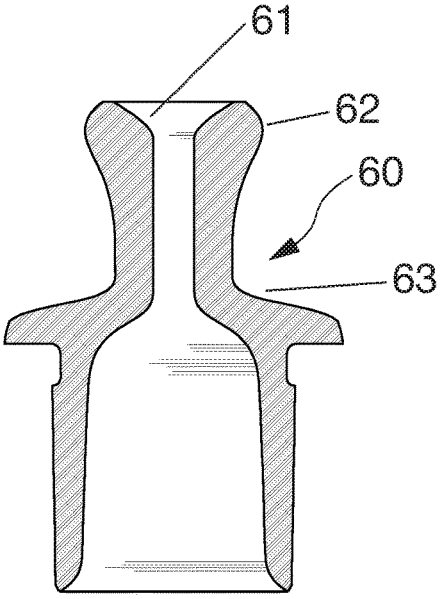
FIG. 17 illustrates an embodiment of an essential oil sampling and dispensing tip insert.

FIG. 17 shows a cut-away view of the essential oil sampling and dispensing tip insert 60. The entire insert 60 is made from an oil-resistant rubber with a side section of the neck 62 which is slightly wider in diameter than the inner diameter of the neck of the sample bottle. The opening at the top of the insert neck 61 can be flat or in a shape that curves inward to promote the oil going back into the bottle.

Figure 18:
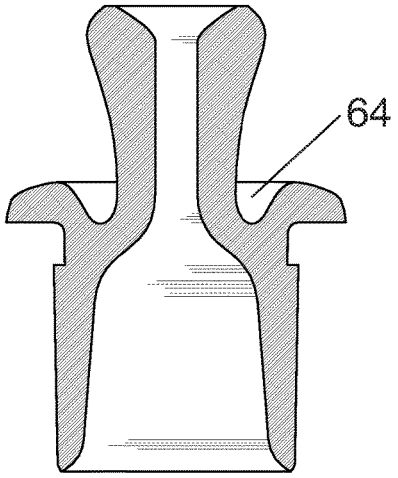
FIG. 18 illustrates an additional embodiment of an essential oil sampling and dispensing tip insert.

FIG. 18 shows a cut-away view of another embodiment of the essential oil sampling and dispensing tip insert similar to the one show in FIG. 17, with an indentation around the base of the neck 64 which can capture excess oil, allow flexibility of the neck, and promote compression of the neck.

Figure 19A:
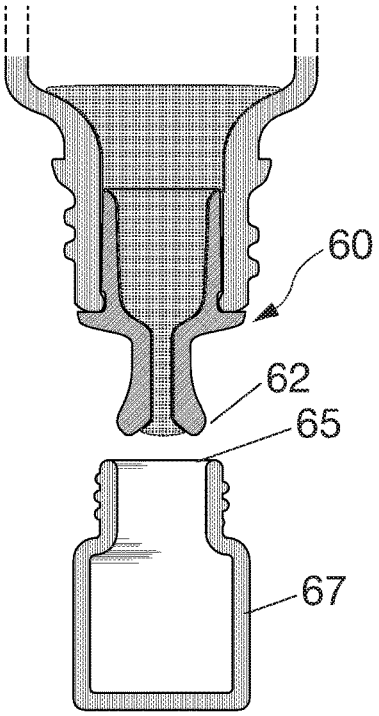
FIG. 19A-19C illustrates a cut-away view of an embodiment of an essential oil sampling and dispensing tip insert being inserted into a sample bottle.
Figure 19B:
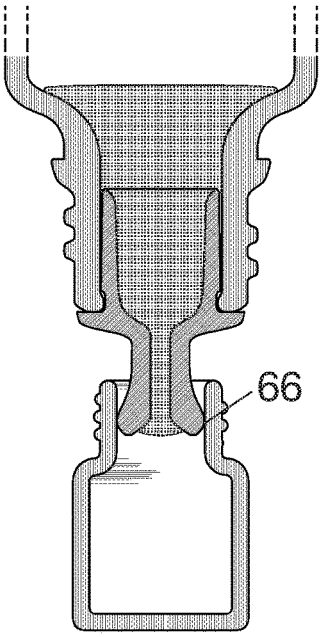
Figure 19C:
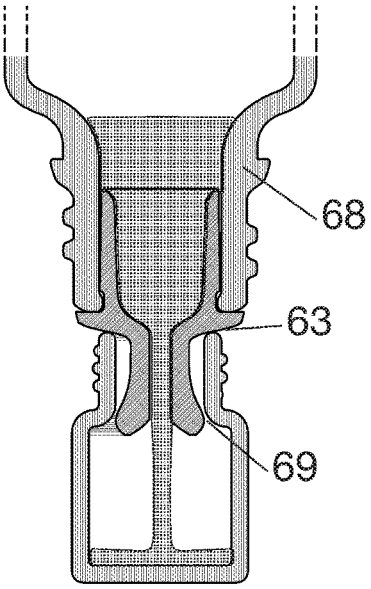

FIGS. 19A-19C illustrate a cut-way side view of the rubber essential oil sampling and dispensing tip insert 60 as it inserts into the neck of a sample bottle 65 for oil sampling. In this embodiment, the tip of the insert is forced into the neck of the sample bottle 67. Because the diameter of the widest part of the neck 62 is slightly larger than the inner diameter of the sample bottle neck 65, it collapses inward slightly 66 to form a tight seal inside the sample bottle (FIG. 19B). The length of the neck of the insert is determined so when it is fully inserted into the neck of the sample bottle 65, the widest part of the neck goes past the neck portion of the sample bottle 65 and maxes out where the top area of the insert 63 contacts the outer ring of the sample bottle, allowing air to enter back into the sample bottle 69, releasing the pressure condition. When the insert 60 is pulled back out of the neck of the sample bottle 65, the widest part of the neck 62 again creates a seal in the neck of the sample bottle 65 and creates a vacuum within the sample bottle 67. This vacuum condition draws oil out of the oil bottle 68 through the essential oil sampling and dispensing tip insert 60 into the sample bottle 67.

Figure 20:
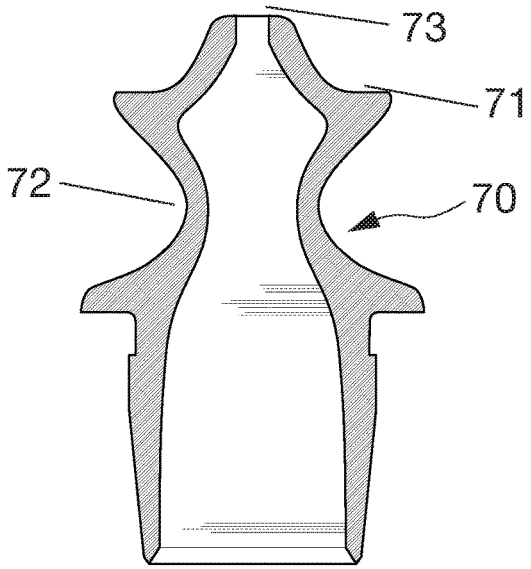
FIG. 20 illustrates an additional embodiment of an essential oil sampling and dispensing tip insert which would force oil out by pressure, rather than pull oil out by a vacuum force. This embodiment represents a flexible upper portion connected/bonded to a rigid plastic base.

FIG. 20 illustrates a cut-away view of the essential oil sampling and dispensing tip insert 70. The flexible upper portion is shaped in such a way to allow it to compress vertically upon itself to diminish the volume, which will force the contents out. A flattened shelf area 71 allows only the tip 73 to enter the sample bottle, and gives the insert a surface to push against the sample bottle to compress the volume of the oil bottle. The entire insert is made from an oil-resistant rubber or flexible material. The lower portion is designed to fit securely into an oil bottle. The upper section is shaped 72 in such a way to allow it to compress vertically upon itself to diminish the volume, either by convexity or concavity, which will force the contents out.

Figure 21:
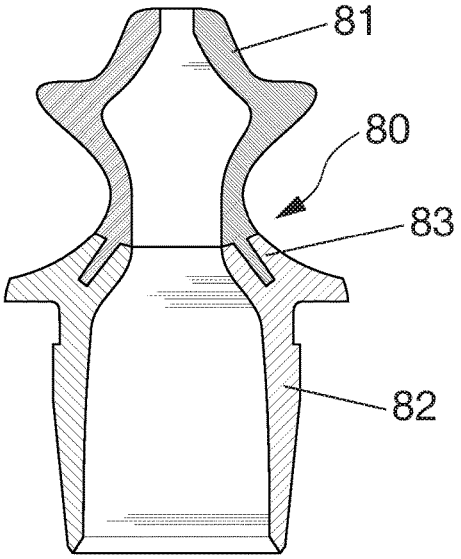
FIG. 21 illustrates an additional embodiment of an essential oil sampling and dispensing tip insert which would force oil out by pressure, rather than pull oil out by a vacuum force. This embodiment represents a version made up entirely of a flexible material, such as Viton rubber.

FIG. 21 illustrates a cut-away view of the essential oil sampling and dispensing tip insert 80. The upper portion 81 of the insert 80 is made from an oil-resistant rubber. The lower section 82 is made from a rigid oil-resistant plastic such as HDPE. The connection point 83 is made by insertion, adhesion, or threaded.

Figure 22A:
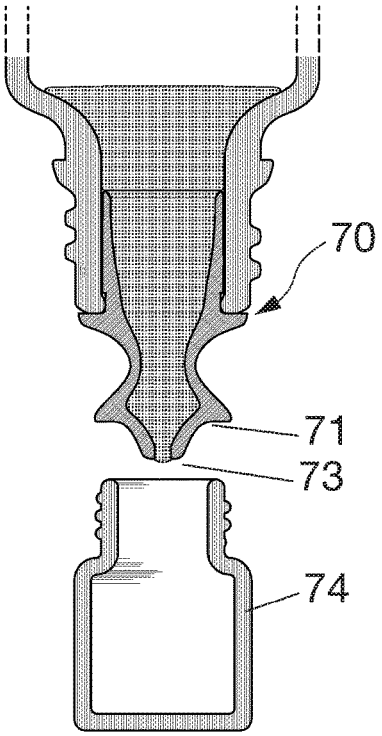
FIG. 22A-22C illustrates a cut-away view of an embodiment of an essential oil sampling and dispensing tip insert pressing onto a sample bottle to force oil inside.
Figure 22B:
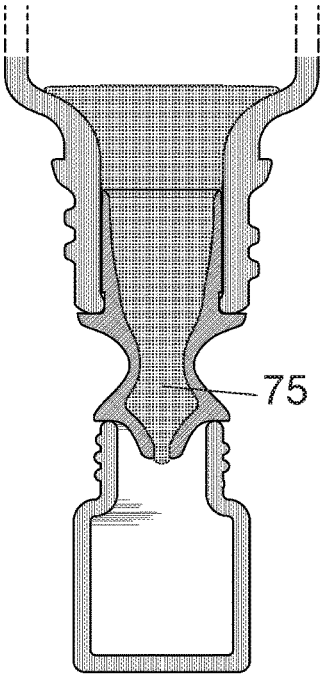
Figure 22C:
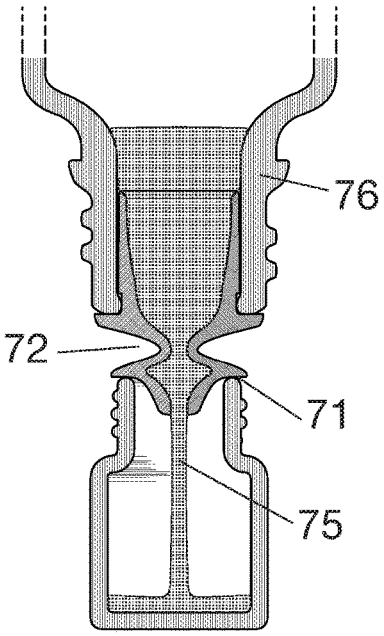

FIGS. 22A-22C illustrate a cut-away side view of the rubber essential oil sampling and dispensing tip insert 70 as it inserts into the neck of a sample bottle 74 for oil sampling. In this embodiment, the tip of the insert 73 is inserted into the neck of the sample bottle 74. The shelf area 71 limits the insert from going inside the sample bottle 74. It also provides a place to push against the sample bottle 74. The insert rests on the sample bottle rim as depicted in FIG. 22B. As the oil bottle 76 and insert are pushed vertically downward, the insert collapses inward (or outward in other embodiments) 72 to compress the volume of the contents, such as oil 75, which forces the contents out of the oil bottle 76 into the sample bottle 74 as shown in FIG. 22C.

Thus, as discussed herein, the embodiments of the present invention embrace a plastic, rubber, or combination essential oil sampling and dispensing tip insert for dispensing essential oil from glass bottles in an efficient and convenient way that eliminates waste. The present invention may be embodied in other specific forms without departing from its spirit or essential characteristics. The described embodiments are to be considered in all respects only as illustrative and not restrictive.

Figure 23:
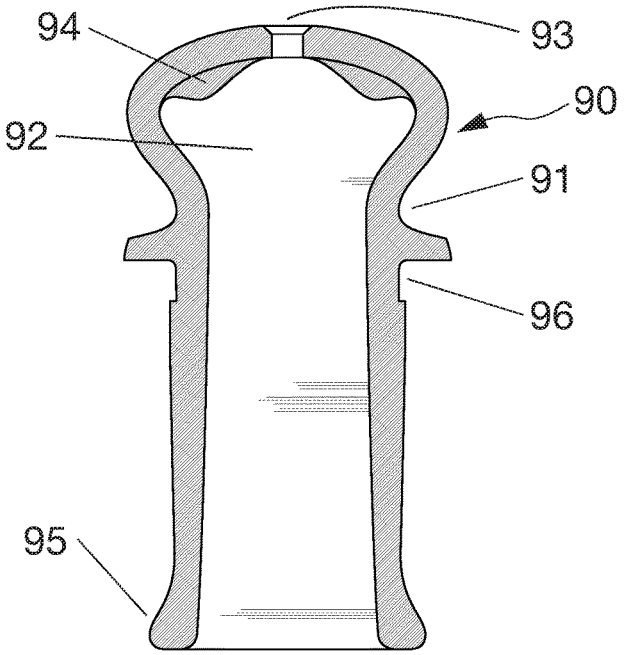
FIGS. 23-25C illustrates a further embodiment of a liquid dispenser.
Figure 24:
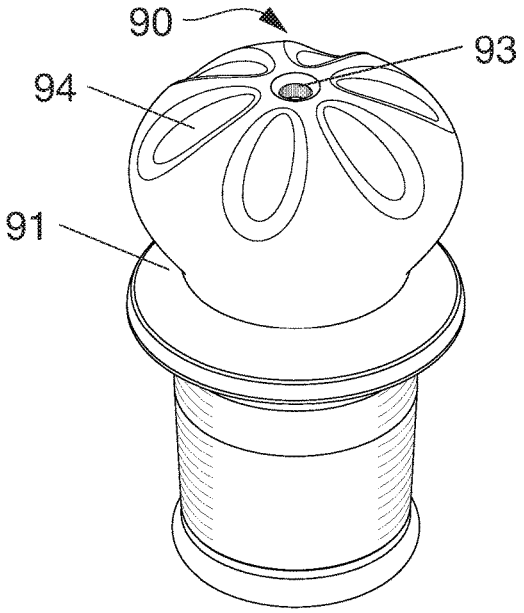

FIG. 23 illustrates a cut-away view of the essential oil sampling and dispensing tip insert 90 of FIG. 24. The illustrated insert 90 includes and upper section 91 which defines an internal upper portion 92. The internal shape of the upper portion may be spherical, elliptical, conical, pyramidal, or have any other simple or complex geometrical shape to facilitate delivery of an internal fluid to an orifice 93 disposed at or near an apex of the upper portion 92.

The flexible, spherical upper portion 92 is shaped in such a way to allow it to compress vertically (in the illustrated orientation) upon itself to diminish the internal volume, which will force the contents out due to one or two separate actions. First, the inward force may cause elastic deformation of the orifice 93 to allow the internal fluid to flow through the orifice 93. Second, the inward force may compress the overall volume of air and/or fluid within the bottle and interior volume of the insert 90, thus increasing the internal pressure to overcome any opposing force, obstacle, or valve mechanism at the orifice 93. In other embodiments, the inward force may be applied by a user squeezing the sides of the upper section 91. However, in some embodiments, the geometry of the orifice may be asymmetrical such that a force to deform the structure around the orifice 93 inward results in opening the orifice 93, whereas a squeezing force on the sides of the upper section 91 results in an outward deformation of the structure around the orifice 93 and closing the orifice 93. Other embodiments may function in reverse, so long as the application of force in different areas of the insert 90 results in opposite functions of the orifice 93 opening or closing in response to the forces. The base of the upper section 91 recesses inward to allow the compression. The lower portion of the insert is designed to fit securely into an oil bottle.

In some embodiments, the insert 90 also includes a pattern of one or more recesses or indentations on the exterior surface of the upper section 91. Although a radial pattern 94 is shown in the figures, in other embodiments, any regular, irregular, concentric, radial, symmetrical, or asymmetrical pattern may be used to achieve the functionality described herein. In some embodiments, the pattern may assist in allowing air to escape the volume of the dispenser into which the liquid is poured or dispensed. Additionally, in some embodiments, the pattern 94 may provide for additional grip between the insert 90 and the lip of the dispenser receiving the liquid. In further embodiments, the pattern facilitates a collapsing movement of the tip of the insert 90.

FIG. 24 illustrates a perspective view of the essential oil sampling and dispensing tip insert 90. The tip insert 90 is made from an oil-resistant rubber or other inert, flexible material. Recesses configured in a radial pattern 94 allow air to enter in the sides when compressing over an oil sampling bottle, so a vacuum suction will not occur.

Figure 25A:
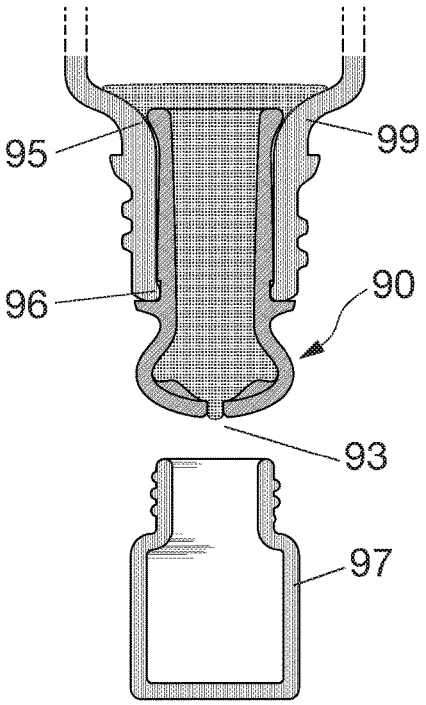
Figure 25B:
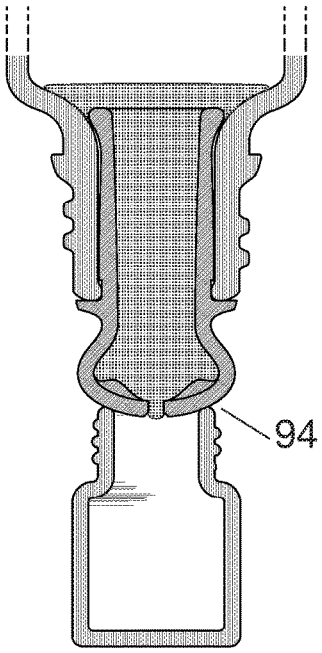
Figure 25C:
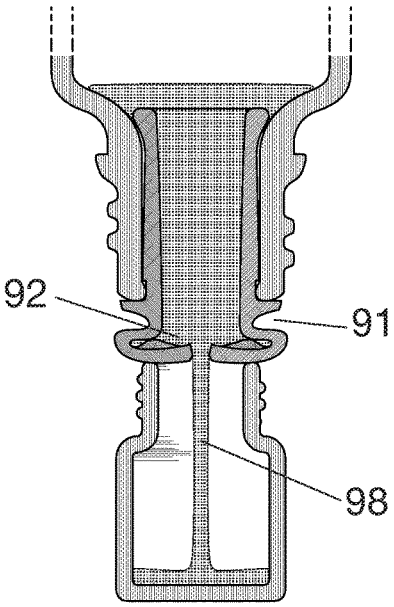

FIGS. 25A-25C illustrate a cut-away side view of the dispensing tip insert 90 shown in FIG. 23 as it inserts into the neck of a sample bottle 97 for oil sampling. In this embodiment, the tip of the insert 90 is centered over or otherwise aligned with the opening of the sample bottle 97. The flared bottom 95 of the insert 90 helps to retain the insert in the dispensing bottle 99 by applying an outward force on the inside surface of the sampling bottle 97, preferably consistent with a flare in the geometry of the sample bottle 97. The recess area 96 of the insert 90 also helps to retain the insert in the dispensing bottle 99. In particular, the recess area 96 may define an indentation which aligns with a corresponding lip or protrusion around the interior surface of the lip of the sampling bottle 97. Additionally, the recess area 96 may partially define a protrusion on the exterior surface of the upper section 91 of the insert 90, which can form a barrier when in contact with the lip of the sampling bottle 97. In the illustrated embodiment, the rounded top of the insert 90 is placed in contact with the opening of sample bottle 97 as depicted in FIG. 25B. As the dispensing bottle 99 and insert 90 are pushed vertically downward or toward the sampling bottle 97, a portion of the insert 90 collapses, limiting the area in the top internal volume 92 of the insert 90. As it compresses the volume of the contents, such as oil 98, it forces the contents out of the dispensing bottle 99 into the sample bottle 97 through the orifice 93 as shown in FIG. 25C.

Thus, as discussed herein, the embodiments of the present invention embrace a plastic, rubber, or otherwise partially pliable material, or combination thereof, for a dispensing tip insert for dispensing essential oil or other liquids from glass bottles or other dispensing containers in an efficient and convenient way that eliminates waste.

In some embodiments, the insert includes a lower section which inserts into any standard essential oil bottle and is held in place by friction and/or undercuts. The insert also may include an upper section comprised of a concave or convex shape, allowing it to be compressed to diminish the space inside and force the contents out. The insert also includes a hole or cross cut which allows the dispensing of the oil contents, and a pattern of convex or concave shapes at the top which prevent the top from getting suctioned onto a receiving sample bottle or capsule.

In one embodiment, the top or upper section (the part visible above the dispensing bottle) is in a convex, bulbous shape, allowing for side compression or vertical force compression. In another embodiment, the top or upper section is in a concave shape which allows for vertical force compression. The opening may be in the form of a hole to allow for the contents to be released or a cross cut which opens up to allow for the contents to be released when pressure is exerted on the insert.

In some embodiments, the top has an undulating series of convex and concave, or only convex or concave, pattern which prevents suction when the insert is placed and pressed onto a sample bottle or a capsule. In other embodiments, the top has a micro or macro texture molded or applied, which prevents section when the insert is placed and pressed onto a sample bottle or a capsule. In further embodiments, a shelf is formed at the top of the insert to easily position the insert over and on top of a sample bottle for vertical compression to release the oil contents. In some embodiments, the shape of the top allows a comfortable application of the oil directly onto the skin of the user by sliding the top of the insert along the surface of the skin.

The present invention may be embodied in other specific forms without departing from its spirit or essential characteristics. The described embodiments are to be considered in all respects only as illustrative and not restrictive.

Other embodiments based on the features and functionality shown and described may be implemented in other specific forms without departing from general understanding of the present invention. The described embodiments are to be considered in all respects only as illustrative and not restrictive. The scope of the claimed invention is, therefore, indicated by the appended claims rather than by the foregoing description. All changes which come within the meaning and range of equivalency of the claims are to be embraced within their scope.

What is claimed is:

1. An apparatus comprising:

a pliable material forming a dispenser insert, wherein the dispenser insert comprises:

a lower section configured for insertion into and stable engagement with the mouth and interior of a dispensing container, wherein the lower section further comprises a flared geometry at a distal end of the lower section, the flared geometry configured to deform inwardly upon insertion into a sampling dispenser and exert an elastic force against an interior surface of the sampling dispenser to maintain the lower section engaged with the sampling dispenser; and an upper section configured to extend outward and away from the mouth of the dispensing container, the upper section defining:

an orifice at a distal end of the upper section; and a pattern of recesses into the outer surface of the upper section, wherein the pattern of recesses is disposed to at least partially define airflow passages between the upper section of the dispenser insert and a lip of a container into which the liquid is dispensed, the orifice configured to maintain:

a closed configuration in an undeformed state; and an open configuration for passage of a liquid in a deformed state subject to application of an external force on the upper section of the dispenser insert.

2. The apparatus of claim 1, wherein the upper section further defines an interior surface geometry with an apex at or near the orifice.

3. The apparatus of claim 1, wherein the upper section further defines the orifice as a circular hole through the pliable material.

4. The apparatus of claim 1, wherein the upper section further defines the orifice as a cross-cut through the pliable material.

5. An apparatus comprising:

a pliable material forming a dispenser insert, wherein the dispenser insert comprises:

a lower section configured for insertion into and stable engagement with the mouth and interior of a dispensing container, wherein the lower section further comprises an indented geometry near the upper section, the indented geometry configured to deform inwardly upon insertion into a sampling dispenser and exert an elastic force against an interior surface of a mouth or lip of the sampling dispenser to maintain the lower section engaged with the sampling dispenser; and an upper section configured to extend outward and away from the mouth of the dispensing container, the upper section defining:

an orifice at a distal end of the upper section; and a pattern of recesses into the outer surface of the upper section, wherein the pattern of recesses is disposed to at least partially define airflow passages between the upper section of the dispenser insert and a lip of a container into which the liquid is dispensed, the orifice configured to maintain:

a closed configuration in an undeformed state; and an open configuration for passage of a liquid in a deformed state subject to application of an external force on the upper section of the dispenser insert.

6. The apparatus of claim 5, wherein the lower section further comprises a ribbed geometry adjacent to the indented geometry, the ribbed geometry configured to contact and engage with the lip or mouth of the sampling dispenser.

7. The apparatus of claim 5, wherein the upper section further defines an interior surface geometry with an apex at or near the orifice.

8. The apparatus of claim 5, wherein the upper section further defines the orifice as a circular hole through the pliable material.

9. The apparatus of claim 5, wherein the upper section further defines the orifice as a cross-cut through the pliable material.

* * * * *